United States Patent [19]

Emery

[11] Patent Number: 4,573,339

[45] Date of Patent: Mar. 4, 1986

[54] MANUAL TOOL FOR SHAPING HORSESHOES

[76] Inventor: Leslie M. Emery, 330-B 5th Ave., Venice, Calif. 90291

[21] Appl. No.: 682,421

[22] Filed: Dec. 17, 1984

[51] Int. Cl.[4] ..... B21D 17/02

[52] U.S. Cl. ..... 72/384; 72/458; 72/477; 81/302; 254/131

[58] Field of Search ..... 72/387, 458, 459, 477, 72/413; 254/131; 81/302

[56] References Cited

U.S. PATENT DOCUMENTS

| | | | |
|---|---|---|---|
| 1,827,363 | 10/1931 | Jacquesson | 72/458 |
| 4,289,015 | 9/1981 | Porter | 72/384 |
| 4,474,046 | 10/1984 | Cook | 72/413 |

*Primary Examiner*—W. D. Bray

*Attorney, Agent, or Firm*—Lyon & Lyon

[57] ABSTRACT

A tool having two elongate members journaled at a central point. Each of the elongate members has certain plugs and flanges which can be brought to bear upon the horseshoe positioned within the tool, such that the shape of the horseshoe can be modified in the way typically needed by a farrier in shaping a horseshoe to fit precisely the hoof of the horse to be shod.

4 Claims, 8 Drawing Figures

MANUAL TOOL FOR SHAPING HORSESHOES

BACKGROUND

1. Field of Invention

This invention pertains to a tool; and more particularly, to a manual tool intended for use in the shaping of horseshoes.

2. Prior Art

The traditional tools used by a farrier to shape an individual horseshoe so that it snugly fits the horse's hoof are the hammer and anvil. In a typical shoeing operation, the hooves of the horse to be shod are first cleaned, cut and trimmed. Any irregularities in the shape of the hoof are reduced to the extent possible. Then, the farrier will either use standard, pre-formed shoes, or, on occasion, a farrier may form his own shoes from straight bar stock. In either event, the shoes must then be fitted to each individual foot on each individual horse. It is highly unusual that two or more of the hooves on any one horse will accept the same size and shape shoe. Further, it is highly unusual for any horse's hoof to accept the standard shoe without some further shaping. Accordingly, in virtually every instance, some shaping of the shoe must be done by the farrier before it is attached to the horse's hoof.

The procedure typically begins with the farrier placing the standard or his personally formed shoe against the horse's hoof and making a mental note of the modifications needed to the shape of the shoe to conform it to the shape of the hoof. The farrier will then take the shoe to the anvil and by placing the shoe in various positions on the anvil and striking the shoe repeatedly with the hammer, modify the shape of the shoe. This process involves repetitively removing the shoe from the anvil after several blows have been administered to check the amount of deformation. The shoe is then again fitted to the horse's hoof, and, in most instances, the process is repeated several times until an exact fit is accomplished. This will typically require several "sightings" of the shoe against the hoof to check for fit. Each such sighting requires that the farrier walk from the location where he has his hammer and anvil back to where the horse is located; the farrier must then position himself under the horse, raise the horse's hoof, compare the fit, put the horse's hoof back on the ground and walk back to the anvil for further modifications.

As the shape of the shoe approaches the shape of the hoof, the modifications may be quite slight, such that the entire operation of raising the horse's hoof, checking the fit, putting the horse's foot back down and walking back to the anvil is undertaken simply to make a very minor adjustment. This is not only time consuming, but can be irritating to the horse, and exhausting to the farrier who must repetitively position himself under the horse and pick up the horse's hoof. It is not unusual for horses to lean against the farrier during this operation, such that the farrier's work load is substantially increased.

Another drawback to the use of the hammer and anvil is that a farrier does encounter instances when it is impossible, or highly difficult, to transport the hammer and anvil to a location near the horse.

There is, therefore, a need in the art for a manual tool which could be used to change the shape of the horseshoe.

SUMMARY OF THE INVENTION

The device of this invention provides such a tool which can accomplish all of the typical shaping operations encountered by the farrier. The tool has two elongate members journaled together at a central journal point. Each of the elongate members has a handle portion for grasping by the farrier, at the other end of which are the operative features of the tool. Those operative features include mirror image plugs formed in the elongate members below the central journal point, and mirror image head sections formed above the central journal point. The tool also has two central flanges, one immediately above the central journal point, the other slightly but directly below the central journal point.

It is therefore the object of this invention to provide a manual tool which is capable of performing the various shaping operations typically encountered by a farrier in fitting a horseshoe to a hoof of a horse.

DESCRIPTION OF THE PREFERRED EMBODIMENT

Figure 1:
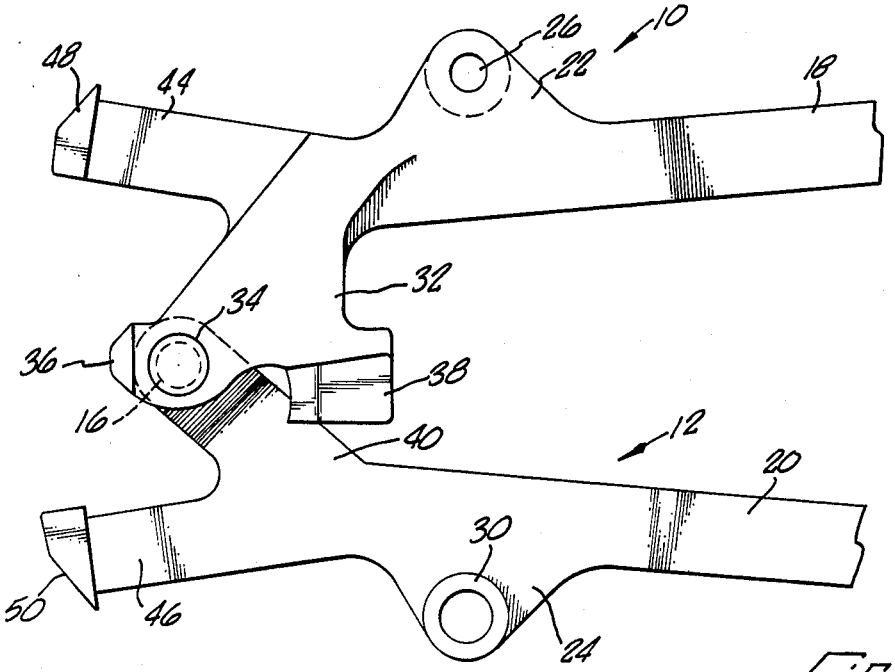
FIG. 1 is a top view of the top portion of the tool of this invention. The handle portions of the elongate members are not shown.

All components of the tool are made of hardcase metal unless otherwise specified.

The tool has a right hand elongate member, generally designated 10, and a left hand elongate member generally designated 12. These members are journaled at a central journal point upon journal pin 16.

The right hand elongate member 10 and the left hand elongate member 12 each have a handle portion 18 and 20, respectively. Although not shown in the figures, the handle portions in the preferred embodiment extend a distance of approximately fourteen inches from the central journal pin 16 so as to provide sufficient leverage to the operator.

Figure 2:
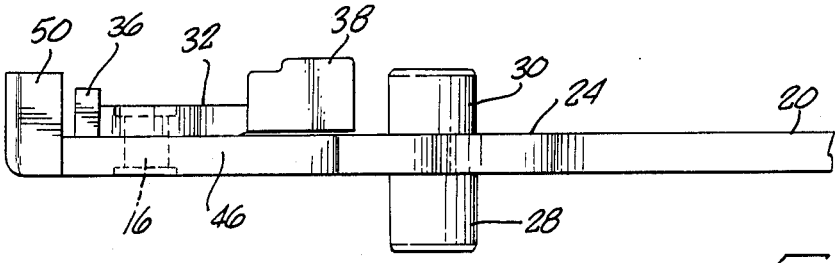
FIG. 2 is a side view of the tool shown in FIG. 1.
Figure 3:
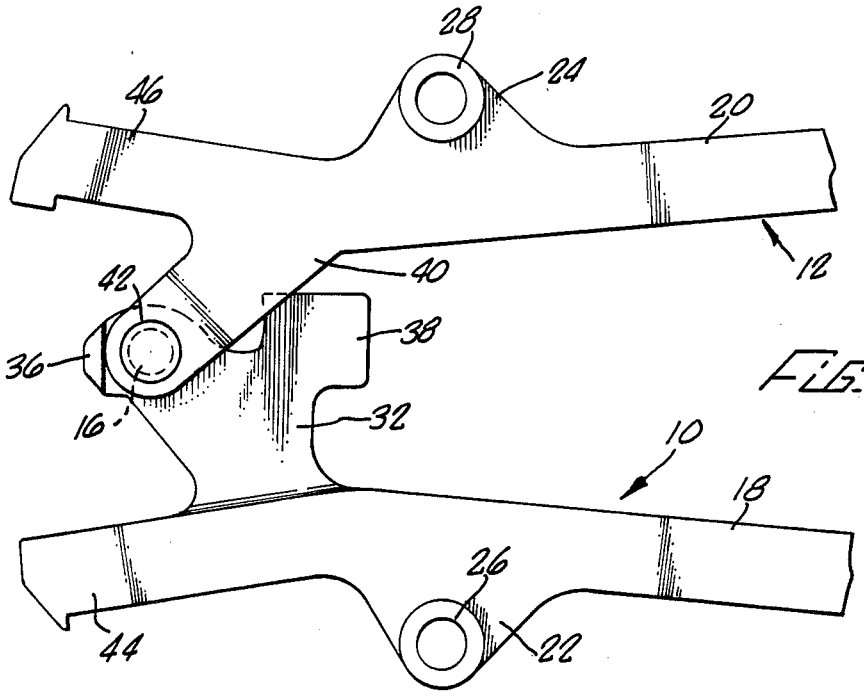
FIG. 3 is a bottom view of the tool shown in FIGS. 1 and 2.

At the end of the handle portion 18, a nib 22 is formed integrally with the right hand elongate member 10, and extends a distance outwardly therefrom (relative to the central journal point). A similar nib 24 is formed in the left hand elongate member, and is the mirror image of nib 22. As can best be seen in FIG. 2, the upper portion of elongate members 10 and 12, as well as nibs 22 and 24, are substantially flat in cross-sectional configuration.

Attached to the right hand nib 22 and extending downwardly therefrom is circular plug 26. The left hand nib 24 has a similar plug 28 which extends below the nib 24 and which is the mirror image of plug 26, but also has a second plug 30 which protrudes on the other side of nib 24.

Extending angularly away from the right hand handle portion 18 is armature 32. In the end of armature 32 is an appropriately sized aperture 34 which provides a receptacle for the journal pin 16. Formed integrally with armature 32 and located directed above journal pin 16 is first flange 36. Also formed integrally with armature 32, and located directed but a small distance below journal pin 16 is second flange 38.

Left hand elongate member 12 also has an armature 40 which extends inwardly and angularly from the end of left hand handle portion 20. Armature 40 also has an appropriately sized aperture 42 which provides a receptacle for the journal pin 16.

Attached to the end of each handle portion 18 and 20 and extending slightly outwardly thereform are mirror image head sections 44 and 46. At the end of each head section 44 and 46, bevelled flanges 48 and 50 are formed integrally therewith. It will be noted that the flanges 48 and 50 are above the central journal pin 16 (relative to the handle portions 18 and 20), and protrude in one direction only.

Figure 4:
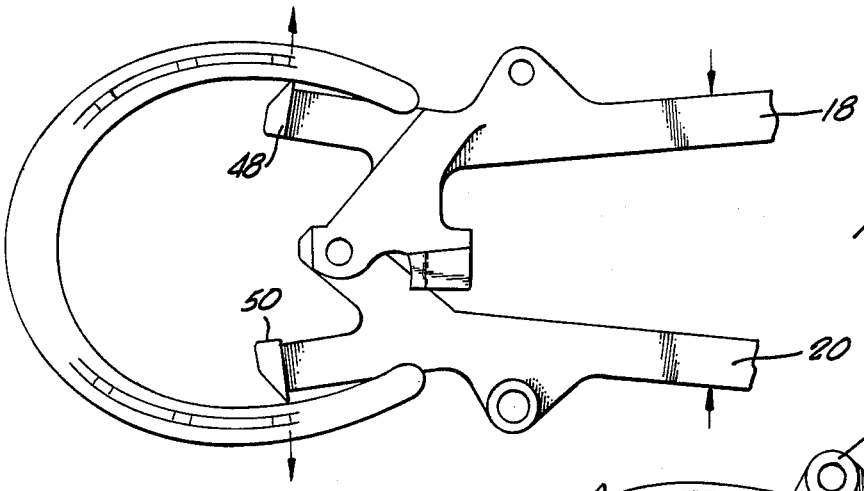
FIG. 4 shows the tool in operation. Here, the tool is being used to separate the forks of the horseshoe. The arrows in this and the following figures indicate the direction of movement or the direction in which force is being applied.
Figure 5:
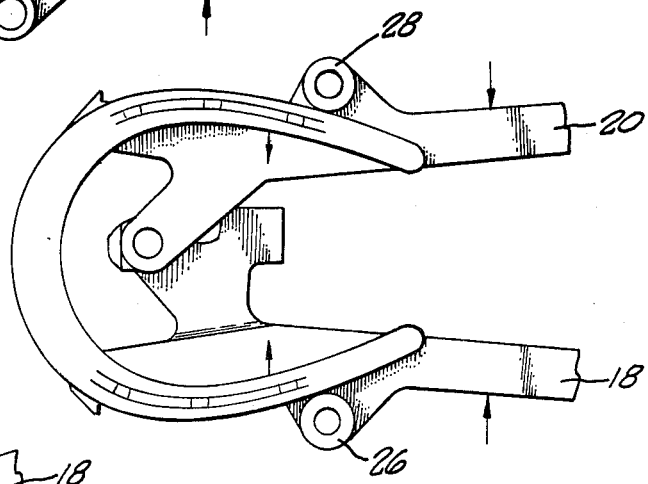
FIG. 5 shows the tool being used to narrow the forks of the horseshoe.

These various components of the tool are sized, spaced and dimensioned so that the standard sizes of horseshoe will fit the tool as shown generally in FIGS. 4 through 8. In FIG. 4, for example, the tool is shown in use spreading the forks of the horseshoe. This operation would be required because the hoof of the horse to be shod is wider than the standard size shoe. Conversely, in FIG. 5, the tool is shown being used to narrow the shoe to fit a horse whose hooves are narrower than the standard size shoe. Here, the plugs 26 and 28 are brought against the shoe.

Figure 6:
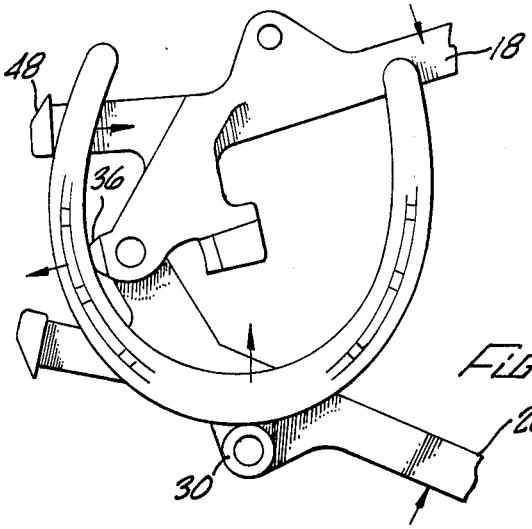
FIG. 6 shows the tool being used to increase the curvature of the forks of the horseshoe.

Horses are often encountered whose hooves are more rounded than the shape of the standard preformed shoe. Accordingly, it is often necessary to increase the curvature of the forks of the shoe. This, too, can be performed with the tool of this invention as shown in FIG. 6. Here, the horseshoe is positioned on the tool such that it is caught between head flange 48, central flange 36 and upper left hand plug 30. As the handle portions 18 and 20 of the tool are brought together, head flange 48 pushes the end of the horseshoe fork inwardly at the same time that central flange 36 pushes the center portion of the horseshoe fork outwardly, and plug 30 puts a restraining inward force on the toe portion of the shoe.

Figure 7:
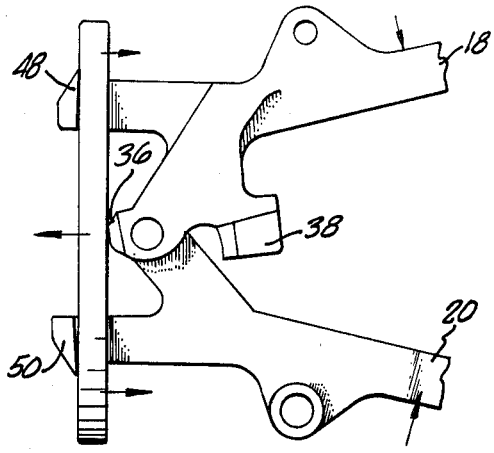
FIG. 7 shows the tool being used to flatten the horseshoe.

In FIG. 7, the horseshoe is positioned such that it is held between the head flanges 48 and 50, and between central flange 36. As the handle portions 18 and 20 are brought together, the head flanges 48 and 50 push inwardly on the shoe, while central flange 36 pushes outwardly on the shoe. This can either be used to flatten or level the shoe or to provide some curvature to the shoe, as needed.

Figure 8:
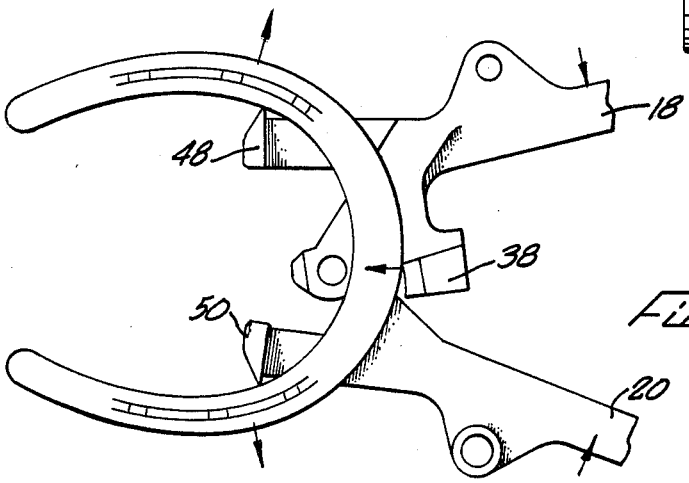
FIG. 8 shows the tool being used to decrease the curvature of the forks of the horseshoe.

When a horse has a very wide hoof, it is necessary to spread the forks of the horseshoe. This operation can be performed with this tool, as shown in FIG. 8. There, the shoe is positioned such that head flanges 48 and 50 are against the interior edges of the forks of the horseshoe, and central flange 38 impinges against the toe portion of the shoe. As the handle portions 18 and 20 are brought together, the head flanges 48 and 50 push outwardly on the forks of the shoe, whereas central flange 38 pushes upwardly on the toe of the shoe, effectively spreading the shoe.

Having depicted and particularly described the preferred embodiment of this invention, it will be apparent to those skilled in the art that many modifications upon the preferred embodiments could be made without departing from the inventive concepts herein claimed. Accordingly, neither this patent nor the protection it provides are limited to the precise embodiments previously depicted and described, but are of the full scope of the claims appended hereto.

What is claimed is:

1. A manual tool for shaping horseshoes, the tool comprising:

(a) two elongate members having opposite ends journaled together at a central journal point, said central journal point being near a first end of said elongate members; the second end of said elongate members to be grasped by the operator of the tool;

(b) at least two plugs attached one each to said elongate members and each protruding prependicularly from the plane in which both said elongate members reside; said plugs being located on said elongate members at a point below said journal point such that each plug moves in the same direction as said second end of said elongate member upon which said plug is located;

(c) at least two head flanges attached one each to said elongate members at the first end thereof, said flanges being above said central journal point such that each head flange moves in a direction opposite to that of the second end of said elongate member to which it is attached; and (d) at least one central flange attached to either elongate member located directly above said central journal point;

all said plugs, head flanges and central flange being sized and spaced apart such that the standard sizes of horseshoe fit therebetween.

2. The tool of claim 1 further comprising a second central flange located directly below said central journal point.

3. The tool of claim 2 further comprising at least one reverse side plug attached to one said elongate member on the opposite side to said plug thereon.

4. A manual tool for shaping horseshoes, the tool having a left hand elongate member having opposite ends, and a right hand elongate member having opposite ends, said members journaled together by means of a journal pin at a central journal point; said right elongate member having:

(i) an elongate handle portion to be gripped at a first end thereof;

(ii) a nib extending laterally and outwardly (relative to said central journal point) from said elongate handle portion near the second end thereof, but below said central journal point, said nib having a plug protruding from one side thereof;

(iii) an armature extending angularly and inwardly (relative to said central journal point) from said elongate handle portion near the second end thereof, the distal end of said armature having an aperture through which said journal pin extends, and said armature having upper and lower flanges, said upper flange being located immediately above said journal pin, said lower flange being located directly but a slight distance below said journal pin, both said flanges extending in a direction opposite to that of said plug on said nib of said elongate handle portion; and (iv) a head section extending substantially axially above said elongate handle portion, such that said handle portion, said armature and said head section have generally a Y-shape, with said head section terminating at a point above (relative to said handle portion) said central journal pin;

and said left hand elongate member having:

(i) an elongate handle portion to be gripped at a first end thereof;

(ii) a nib which is generally the mirror image of said nib on said right hand handle portion, said nib on said left hand handle portion having plugs protruding from either side thereof;

(iii) an armature which extends angularly, inwardly and upwardly from said handle portion and having in the distal end thereof an aperture through which said journal pin extends; and (iv) a head section which is generally the mirror image of said head section on said right hand elongate member;

such that upon pulling said handle portions together causes said plugs on said right hand and said left hand elongate members to be brought together, and said head sections to be forced apart.

* * * * *